United States Patent [19]

Krummel et al.

[11] 3,985,669

[45] Oct. 12, 1976

[54] DETERGENT COMPOSITIONS

[75] Inventors: H. Karl Krummel; Terrell W. Gault, both of Cincinnati, Ohio

[73] Assignee: The Procter & Gamble Company, Cincinnati, Ohio

[22] Filed: June 17, 1974

[21] Appl. No.: 479,951

[52] U.S. Cl. ..... 252/116; 252/89 R; 252/131; 252/135; 252/140; 252/179; 252/531; 252/532; 252/539; 252/540

[51] Int. Cl.[2] ..... C11D 9/18

[58] Field of Search ..... 252/99, 131, 133, 135, 252/140, 179, 455 Z, 89, 116, 531, 532, 539, 540; 210/24, 38 A, 41; 423/118, 328, 329

[56] References Cited

UNITED STATES PATENTS

| | | | |
|---|---|---|---|
| 2,882,243 | 4/1959 | Milton | 252/455 Z |
| 3,112,176 | 11/1963 | Haden | 423/329 |
| 3,154,494 | 10/1964 | Speak | 252/96 |
| 3,424,545 | 1/1969 | Bauman | 8/137 |
| 3,755,180 | 8/1973 | Austin | 252/99 |
| 3,783,008 | 1/1974 | Weldes et al. | 117/100 A |
| 3,812,044 | 5/1974 | Conner et al. | 252/89 |
| 3,852,211 | 12/1974 | Ohren | 252/110 |
| 3,862,058 | 1/1975 | Nirschl | 252/528 |

FOREIGN PATENTS OR APPLICATIONS 7,406,306 11/1974 Netherlands

OTHER PUBLICATIONS

Appelius, W.: "Water Softening by the Permutite Methods", Chem. Abstracts, vol. 4, p. 630.

Glasgow, J. D.: "The Use of Permutite and Polarite in Water Purification", Chem. Abstracts, vol. 9, p. 676.

Lesser, M. A.: "Bentonite as a Detergent", Soap and Sanitary Chemicals, Oct., 1945, pp. 37–40.

Hammond, "Phosphate Replacements: Problems with the Washday Miracle", Science, vol. 172, Apr. 23, 1971, pp. 361–363.

*Primary Examiner*—Thomas J. Herbert, Jr.
*Assistant Examiner*—Bruce H. Hess
*Attorney, Agent, or Firm*—Julius P. Filcik; Robert B. Aylor; Thomas H. O'Flaherty

[57] ABSTRACT

Detergent compositions containing water-insoluble aluminosilicate ion exchange materials, organic surface-active agents and a minor amount of silicate solids. The aminosilicate ion exchange materials are characterized by the speed and efficiency with which they are capable of removing hardness ions from the washing liquor. A minor amount of sodium silicate solids is used to provide effective corrosion inhibition and crispness to the detergent granules. The instant compositions are capable of providing, during conventional laundry cleaning operations, superior performance, particularly appearance benefits resulting from their effective anti-deposition properties.

19 Claims, No Drawings

DETERGENT COMPOSITIONS

BACKGROUND OF THE INVENTION

This invention relates to granular detergent compositions which are capable of providing superior performance during conventional textile laundering and cleaning operations. In more detail, the compositions of this invention contain as essential components an organic surface-active agent, a water-insoluble aluminosilicate ion exchange material and a minor amount of an alkali oxide silicate solid.

The use of water-insoluble synthetic aluminosilicates in detergent compositions in combination with organic surface-active agents is described in copending U.S. patent application Ser. No. 359,293, filed Mar. 11, 1974, titled "Detergent Composition", inventors Corkill, et al. The compositions of Corkill et al., though excellent performers, can require the presence of a metal corrosion inhibitor to protect the washing machine and also an agent to render the granules more crisp and accordingly to confer better free-flowing characteristics. In conventional heavyduty detergent compositions, satisfactory corrosion inhibition and granule crispness are obtained through the incorporation of sodium silicate in an amount from about 6% to about 20%. Although the compositions of Corkill et al. will provide acceptable cleaning performance, the combination of organic surfactants, water-insoluble aluminosilicates and silicate in the normal levels can present deposition problems which can adversely affect the appearance of the textile. Hence, under certain circumstances, it can be desirable to avoid these appearance shortcomings without resorting to exotic and commercially unattractive inhibitors and crispness agents.

It is known that laundry compositions function more efficiently in soft water than in water containing significant amounts of dissolved "hardness" cations such as calcium ion, magnesium ion and the like. Zeolites or other cation exchange materials were frequently used to pre-soften water. Such pre-softening procedures require an additional expense to the user occasioned by the need to purchase the softener appliance.

Another means whereby fabrics can be optimally laundered under hard water conditions involves the use of water-soluble builder salts and/or chelators to sequester the undesirable hardness cations and to effectively remove them from interaction with the fabrics and detergent materials in the laundering liquor. However, the use of such water-soluble builders necessarily introduces into the water supply certain materials which, in improperly treated sewerage effluents, may be undesirable. Accordingly, a means for providing water-softening builders in detergent compositions without the need for soluble builder additives is desirable.

A variety *x* methods have been suggested for providing builder and water-softening action concurrently with the deterging cycle of a home laundering operation, but without the need for water-soluble detergent additives. One such method employs a phosphorylated cloth which can be added to the laundry bath to sequester hardness ions and which can be removed after each laundering; see U.S. Pat. No. 3,424,545.

The use of certain clay minerals to adsorb hardness ions from laundering liquors has also been suggested; see, for example, Rao, in Soap Vol. 3 No. 3 pp. 3–13 (1950); Schwarz, et al. "Surface Active Agents and Detergents", Vol. 2, p, 297 et seq. (1966).

Zeolites, especially naturally-occurring aluminosilicate zeolites, have been suggested for use in washing compositions; see U.S. Pat. No. 2,213,641; also U.S. Pat. No. 2,264,103.

Various aluminosilicates have been suggested for use as adjuncts to and with detergent compositions; see, for example, U.S. Pat. Nos. 923,850; 1,419,625; and British Pat. Nos. 339,355; 461,103; 462,591; and 522,097.

From the foregoing it is seen that a variety of methods have been heretofore employed to remove hardness cations from aqueous laundering systems concurrently with the deterging cycle of a home laundry operation. However, these methods have not met with general success, primarily due to the inability of the art-disclosed materials to rapidly and efficiently reduce the free polyvalent metal ion content of the aqueous laundering liquor to acceptable hardness levels. To be truly useful in laundry detergent compositions, an ion exchange material must have sufficient cation exchange capacity to significantly decrease the hardness of the laundry bath without requiring excessive amounts of the ion exchanger. Moreover, the ion exchange material must act rapidly, i.e., it must reduce the cation hardness in an aqueous laundry bath to an acceptable level within the limited time (ca. 10–12 minutes) available during the deterging cycle of a home laundering operation. Optimally, effective ion exchange materials should be capable of reducing calcium hardness to about 1 to 2 grains per gallon within the first 1 to 3 minutes of the deterging cycle. Finally, useful cation exchange builders are desirably substantially water-insoluble, inorganic materials which present little or no ecological problems in sewage.

It is an object of this invention to provide detergent compositions containing water-insoluble aluminosilicate ion exchange materials which are capable of providing superior performance, particularly textile appearance benefits.

It is a further object of this invention to provide detergent compositions containing water-insoluble aluminosilicates having effective corrosion inhibition and granule crispness characteristics.

The above and other objects are now met as will be seen from the following disclosure.

SUMMARY OF THE INVENTION

The instant invention is based on the discovery that cleaning and washing compositions capable of rapidly reducing the free polyvalent metal ion content in laundry liquor and which are capable of imparting appearance benefits to textiles laundered therein, can now be prepared comprising a particular water-insoluble aluminosilicate ion exchange material, surface-active agents and a minor amount of alkali silicate solids. In particular, the compositions of this invention comprise:

a. from about 5% to about 92% by weight of a water-insoluble aluminosilicate ion exchange material of the formula $$Na_z[(AlO_2)_z.(SiO_2)_y]x\ H_2O$$

wherein *z* and *y* are integers of at least 6; the molar ratio of *z* to *y* is in the range from 1.0 to about 0.5, and *x* is an integer from about 15 to about 264; said aluminosilicate ion exchange material having a particle size diameter from about 0.1 micron to about 100 microns;

a calcium ion exchange capacity of at least about 200 mg. eg. $CaCO_3$/g.; and a calcium ion exchange rate of at least about 2 grains ($Ca^{++}$)/gallon/minute/gram; and b. from about 5% to about 92% by weight of a water-soluble organic surface-active agent selected from the group consisting of anionic, nonionic, ampholytic and zwitterionic surface-active agents and mixtures thereof; and c. from about 0.5% to about 3% by weight of an alkali metal silicate solid having a molar ratio of $SiO_2$ to alkali metal oxide in the range from about 0.5 to about 4.0.

In a preferred embodiment, the water-insoluble aluminosilicate ion exchange material has the formula $$Na_{12}[(AlO_2)_{12}(SiO_2)_{12}].x\ H_2O$$

wherein $x$ is an integer from about 20 to about 30, especially about 27. The alkali metal silicates are preferably used in an amount from about 0.9% to about 2% by weight having a molar ratio of $SiO_2$ to alkali metal oxide in the range from about 2.0 to about 3.4.

The detergent compositions herein can contain, in addition to the essential components listed, various other ingredients commonly employed in detergent compositions. In a particularly preferred embodiment, auxiliary water-soluble detergent builders are employed in the compositions to aid in the removal of calcium hardness and to sequester magnesium cations in water. Such preferred co-builder systems for use in the compositions herein comprise well-defined and narrow ratios of synthetic aluminosilicate to said co-builders.

DETAILED DESCRIPTION OF THE INVENTION

The compositions of this invention comprise (1) a water-insoluble aluminosilicate ion exchange material; (2) an organic surface-active agent; and (3) a minor amount of an alkali metal oxide silicate solid; these essential ingredients being discussed in detail hereinafter.

Unless stated to the contrary, the "percent" indications stand for percent by weight.

ALUMINOSILICATE ION EXCHANGE MATERIAL

The aluminosilicate ion exchange materials herein are prepared by a process which results in the formation of materials which are particularly suitable for use as detergency builders and water softeners. Specifically, the aluminosilicates herein have both a higher calcium ion exchange capacity and a higher exchange rate than similar materials heretofore suggested as detergency builders. Such high calcium ion exchange rate and capacity appear to be a function of several interrelated factors which result from the method of preparing said aluminosilicate ion exchange materials.

One essential feature of the ion exchange builder materials herein is that they be in the "sodium form". That is to say, it has surprisingly been found, for example, that the potassium and hydrogen forms of the instant aluminosilicate exhibit neither the exchange rate nor the exchange capacity necessary for optimal builder use.

A second essential feature of the ion exchange builder materials herein is that they be in a hydrated form, i.e. contain 10%–28%, preferably 10%–22%, of water. Highly preferred aluminosilicates herein frequently contain from about 18% to about 22% water in their crystal matrix. It has been found, for example, that less highly hydrated aluminosilicates, e.g. those containing about 6% water, do not function effectively as ion exchange builders when employed in the context of a laundry detergent composition.

A third essential feature of the ion exchange builder materials herein is their particle size range. Proper selection of small particle sizes results in fast, highly efficient builder materials.

The method set forth below for preparing the aluminosilicates herein takes into consideration all of the foregoing essential elements. First, the method avoids contamination of the aluminosilicate product by cations other than sodium. For example, product washing steps involving acids or bases other than sodium hydroxide are avoided. Second, the process is designed to form the aluminosilicate in its most highly hydrated form. Hence, high temperature heating and drying are avoided. Third, the process is designed to form the aluminosilicate materials in a finely-divided state having a narrow range of small particle sizes. Of course, additional grinding operations can be employed to still further reduce the particle size. However, the need for such mechanical reduction steps is substantially lessened by the process herein.

The aluminosilicates herein are prepared according to the following procedures:

a. dissolved sodium aluminate ($Na\ AlO_2$) in water to form a homogeneous solution having a concentration of $Na\ AlO_2$ of about 16.5% (preferred);

b. add sodium hydroxide to the sodium aluminate solution of step (a) at a weight ratio of NaOH-$Na\ AlO_2$ of 1:1.8 (preferred) and maintain the temperature of the solution at about 50° C until all the NaOH dissolves and a homogeneous solution forms;

c. add sodium silicate ($Na_2\ SiO_3$ having a $SiO_2$:$Na_2O$ weight ratio of 3.2 to 1) to the solution of step (b) to provide a solution having a weight ratio of $Na_2SiO_3$-NaOH of 1.14:1 and a weight ratio of $Na_2SiO_3$:-$NaAlO_2$ of 0.63:1;

d. heat the mixture prepared in step (c) to about 90° C – 100° C and maintain at this temperature range for about one hour.

In a preferred embodiment, the mixture of step (c) is cooled to a temperature below about 25° C, preferably in the range from 17° C to 23° C, and maintained at that temperature for a period from about 25 hours to about 500 hours, preferably from about 75 hours to about 200 hours.

The mixture resulting from step (d) is cooled to a temperature of about 50° C and thereafter filtered to collect the desired aluminosilicate solids. If the low temperature (<25° C) crystallization technique is used, then the precipitate is filtered without additional preparatory steps. The filter cake can optionally be washed free of excess base (deionized water wash preferably to avoid cation contamination). The filter cake is dried to a moisture content of 18% – 22% by weight using a temperature below about 150° C to avoid excessive dehydration. Preferably, the drying is performed at 100° C – 105° C.

Following is a typical pilot-plant scale preparation of the aluminosilicates herein.

PREPARATION OF ALUMINOSILICATE BUILDER

| Component | Pounds (As Is) | Pounds (Anhydrous) | Water | Wt.% Of Total |
|---|---|---|---|---|
| $NaAlO_2$ | 57.72 | 49.454 | 8.27 | 16.40 (Anh.) |
| Sodium Silicate (3.2:1 $SiO_2$:$Na_2O$) | 82.52 | 30.945 | 51.57 | 10.26 (Anh.) |
| NaOH | 54.96 | 27.304 | 27.66 | 9.5 (Anh.) |
| $H_2O$ (deionized) | 106.40 | | 106.40 | 65.29 |

The sodium aluminate was dissolved in the water with stirring and the sodium hydroxide added thereto. The temperature of the mixture was maintained at 50° C and the sodium silicate was added thereto with stirring. The temperature of the mixture was raised to 90° C – 100° C and maintained within this range for 1 hour with stirring to allow formation of a synthetic aluminosilicate ion exchange material having the formula $Na_{12}$-$(AlO_2.SiO_2)_{12}$.27 $H_2O$. The mixture was cooled to 50° C, filtered, and the filter cake washed twice with 100 lbs. of deionized water. The case was dried at a temperature of 100° C – 105° C to a moisture content of 18% – 22% by weight to provide the aluminosilicate builder material. This synthetic aluminosilicate ion exchange material is known under the commercial denomination ZEOLITE A; in the dehydrated form it can be used as a molecular sieve and catalyst carrier.

The aluminosilicates prepared in the foregoing manner are characterized by a cubic crystal structure and may additionally be distinguished from other aluminosilicates on the basis of the X-ray powder diffraction pattern. X-ray analysis data for the above synthetic aluminosilicate were obtained on PHILIPS ELECTRONICS X-ray diffraction equipment. This included a nickel filtered copper target tube at about 1100 watts of input power. Scintillation detection with a strip chart recorder was used to measure the diffraction from the spectrometer. Calculation of the observed d-values was obtained directly from the spectrometer chart. The relative intensities were calculated with Io as the intensity of the strongest line or peak. The synthetic aluminosilicate ion exchange material having the formula $$Na_{12}[(AlO_2)_{12}.(SiO_2)_{12}].27\ H_2O$$

prepared as described hereinbefore had the following X-ray diffraction pattern:

| d | I/Io | d | I/Io |
|---|---|---|---|
| 12.3 | 100 | 2.15 | 10 |
| 8.67 | 70 | 2.11 | 4 |
| 7.14 | 35 | 2.09 | 4 |
| 6.35 | 1 | 2.06 | 10 |
| 5.50 | 25 | 1.92 | 8 |
| 5.04 | 2 | 1.90 | 4 |
| 4.36 | 6 | 1.86 | 2 |
| 4.11 | 35 | 1.84 | 4 |
| 3.90 | 2 | 1.76 | 2 |
| 3.71 | 50 | 1.74 | 14 |
| 3.42 | 16 | 1.69 | 6 |
| 3.29 | 45 | 1.67 | 2 |
| 3.08 | 2 | 1.66 | 2 |
| 2.99 | 55 | 1.63 | 4 |
| 2.90 | 10 | | |
| 2.76 | 12 | | |
| 2.69 | 4 | | |
| 2.62 | 20 | | |
| 2.52 | 6 | | |
| 2.47 | 4 | | |
| 2.41 | 1 | | |
| 2.37 | 4 | | |
| 2.29 | 1 | | |
| 2.25 | 4 | | |

-continued

| d | I/Io | d | I/Io |
|---|---|---|---|
| 2.18 | 8 | | |

The above diffraction pattern substantially corresponds to the pattern of ASTM powder diffraction card file No. 11-590.

Water-insoluble aluminosilicates having a molar ratio of $(AlO_2)$:$(SiO_2)$ smaller than 1, i.e. in between 1.0 and about 0.5, preferably in between 1.0 and about 0.8 can be prepared in a similar manner. These aluminosilicate ion exchange materials ($AlO_2$:$SiO_2$<1) are also capable of effectively reducing the free polyvalent hardness metal ion content of an aqueous washing liquor in a manner substantially similar to the aluminosilicate ion exchange material having a molar ratio of $AlO_2$:$SiO_2$ = 1 as described hereinbefore. Examples of aluminosilicates having a molar ratio: $AlO_2$:$SiO_2$<1, suitable for use in the instant compositions include:

$$Na_{86}[(AlO_2)_{86}(SiO_2)_{106}].264\ H_2O;\ \text{and}$$

$$Na_6[(AlO_2)_6(SiO_2)_{10}].15\ H_2O.$$

Although completely hydrated aluminosilicate ion exchange materials are preferred herein, it is recognized that the partially dehydrated aluminosilicates having the general formula given hereinbefore are also excellently suitable for rapidly and effectively reducing the water hardness during the laundering operation. Of course, in the process of preparing the instant aluminosilicate ion exchange material, reaction-crystallization parameter fluctuations can result in such partially hydrated materials. As pointed out previously, aluminosilicates having about 6% or less water do not function effectively for the intended purpose in laundering context. The suitability of particular partially dehydrated water-insoluble aluminosilicates for use in the compositions of this invention can easily be asserted and does only involve routine testing as, for example, described herein (Ca-ion exchange capacity; rate of exchange).

The ion exchange properties of the aluminosilicates herein can conveniently be determined by means of a calcium ion electrode. In this technique, the rate and capacity of $Ca^{++}$ uptake from an aqueous solution containing a known quantity of $Ca^{++}$ ion is determined as a function of the amount of aluminosilicate ion exchange material added to the solution.

The water-insoluble, inorganic aluminosilicate ion exchange materials prepared in the foregoing manner are characterized by a particle size diameter from about 0.1 micron to about 100 microns. Preferred ion exchange materials have a particle size diameter from about 0.2 micron to about 10 microns. The term "particle size diameter" herein represents the average particle size diameter of a given ion exchange material as determined by conventional analytical techniques such as, for example, microscopic determination, scanning electron microscope (SEM).

The aluminosilicate ion exchangers herein are further characterized by their calcium ion exchange capacity, which is at least about 200 mg. equivalent of $CaCO_3$ hardness/gram of aluminosilicate, calculated on an anhydrous basis, and which generally lies within the range of from about 300 mg. eq./g. to about 352 mg. eq./g. This corresponds to a calcium ion exchange capacity of at least about 4.00 meq./g. and preferably from about 6.00 to about 7.04 meq./g. measured as milliequivalents of calcium ion per gram of aluminosilicate.

The ion exchange materials herein are still further characterized by their calcium ion exchange rate, which is at least about 2 grains ($Ca^{++}$)/gallon/minute/-gram of aluminosilicate (anhydrous basis), and lies within the range of about 2 grains/gallon/minute/gram to about 6 grains/gallon/minute/gram, based on calcium ion hardness. Optimum aluminosilicates for builder purposes exhibit a $Ca^{++}$ exchange rate of at least about 4 grains/gallon/minute/gram.

The foregoing procedure for preparing the aluminosilicate ion exchange materials herein can be modified in its various process steps, as follows. Step (a) can be modified by using solution concentrations of $NaAlO_2$ of from 5% to 22% by weight; the optimum concentration is 16% to 16.5%. Step (b) can be modified by deletion of the NaOH. Sodium hydroxide is not required to form the aluminosilicates herein but its use is preferred to initiate the reaction and to maintain reaction efficiency. Step (b) can be further modified by use of temperatures within the range of from about 30° C to about 100° C; 50° C is preferred. Step (c) can be modified by varying the ratio of aluminate to silicate. In order to satisfy the 1:1 $AlO_2$:$SiO_2$ stoichiometry requirements of a specifically preferred species in the final product, it is necessary to provide in that particular case at least a 1:1 mole ratio of $AlO_2$:$SiO_2$ (based on $NaAlO_2$ and $Na_2SiO_3$) in the mix. In that latter event, it is highly preferred to employ an excess of $NaAlO_2$, inasmuch as excess $NaAlO_2$ has been found to promote the rate and efficiency of the formation reaction of aluminosilicates having a 1:1 molar ratio of $AlO_2$:$SiO_2$. Suitable water-insoluble aluminosilicate ion exchange materials having a molar ratio of $AlO_2$:$SiO_2$ of less than about 1.0, i.e. from 1.0 to about 0.5, can be prepared as described hereinbefore except that the molar amount of $SiO_2$ is increased. The proper determination of the excess silicate to be used in the formation reaction can easily be optimized and does only require a routine investigation.

Step (d) can be modified to employ temperatures from 50° C to 110° C at ambient pressures; 90° C to 100° C is optimal. Of course, higher temperatures can be employed if high pressure equipment is used to prepare the aluminosilicates. When the high-temperature (90°–100° C) crystallization technique is used, step (d) will normally require a formation reaction time of about 1 to 3 hours. As noted hereinbefore, an additional possibility for preparing the ion exchange materials resides in modifying step (d) by cooling the mixture of step (c) to a temperature below about 25° C, preferably in the range from 17° C–23° C, and maintaining said mixture at that temperature for a period from about 25 hours to 500 hours, preferably from about 75 hours to about 200 hours.

Following the formation of the aluminosilicates by the foregoing procedure, the materials are recovered and dried. When employed as ion exchange builders, the aluminosilicates must be in a highly hydrated form, i.e. 10% to 28%, preferably 10% to 22%, by weight of water. Accordingly, drying of the aluminosilicates must be carried out under controlled temperature conditions. Drying temperatures of from about 90° C to about 175° C can be employed. However, at drying temperatures from about 150° C to about 175° C, the less highly hydrated materials (ca, 10% $H_2O$) are obtained. Accordingly, it is preferred to dry the aluminosilicates at 100° C to 105° C, whereby the optimum builder materials containing 18% to 22% of water are secured. At these latter temperatures, the stability of the preferred 27-hydrate form of the aluminosilicate is independent of drying time.

The ion exchange materials prepared in the foregoing manner can be employed in laundering liquors at levels of from about 0.005% to about 0.25% of the liquor, and reduce the hardness level, particularly calcium hardness, to a range of about 1 to 3 grains/gallon within about 1 to about 3 minutes. Of course, the usage level will depend on the original hardness of the water and the desires of the user. Preferred detergent compositions herein comprise from about 10% to about 50%, especially from about 12% to about 30% of the aluminosilicate builder and from about 7% to about 50% by weight of the water-soluble, organic surface active component.

DETERGENT COMPONENT

The detergent compositions of the instant invention can contain all manner of organic, water-soluble surface-active agents, inasmuch as the aluminosilicate ion exchangers are compatible with all such materials. The surface-active component is used in an amount from about 5% to about 92%, preferably from about 7% to about 50% of the detergent compositions. A typical listing of the classes and species of detergent compounds useful herein appears in U.S. Pat. No. 3,664,961, incorporated herein by reference. The following list of detergent compounds and mixtures which can be used in the instant compositions is representative of such materials, but is not intended to be limiting.

Water-soluble salts of the higher fatty acids, i.e. "soaps", are useful as the detergent component of the compositions herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e. sodium or potassium tallow and coconut soap.

Another class of detergents includes water-soluble salts, particularly the alkali metal, ammonium and alkylolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic detergents which form a part of the detergent compositions of the present invention are the sodium and potassium alkyl sulfates, especially those obtained by sulfating the higher alcohols ($C_8 - C_{18}$ carbon atoms) produced by reducing the glycerides of tallow or coconut oil; and sodium and potassium alkyl benzene sulfonates, in which the alkyl group contains from about 9 to about 15 carbon atoms, in straight chain or branched chain configuration, e.g. those of the type described in U.S. Pat. Nos. 2,220,099 and 2,477,383. Especially valuable are linear straight chain alkyl benzene sulfonates in which the average of the alkyl groups in about 13 carbon atoms, abbreviated as $C_{13}$ LAS.

Other anionic detergent compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Water-soluble nonionic synthetic detergents are also useful as the detergent component of the instant composition. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name of "Pluronic." These compounds are formed by condensing ethylene oxide with a hydrophobic base formed by the condensation of propylene oxide with propylene glycol. Other suitable nonionic synthetic detergents include the polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol.

The water-soluble condensation products of aliphatic alcohols having from 8 to 22 carbon atoms, in either straight chain or branched configuration, with ethylene oxide, e.g., a coconut alcohol-ethylene oxide condensate having from 5 to 30 moles of ethylene oxide per mole of coconut alcohol, the coconut alcohol fraction having from 10 to 14 carbon atoms, are also useful nonionic detergents herein.

Semi-polar nonionic detergents include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water solubilizing group.

Other useful detergent compounds herein include the water-soluble salts of esters of $\alpha$-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble organic detergent compounds herein include linear alkyl benzene sulfonates containing from about 11 to 14 carbon atoms in the alkyl group; the tallow range alkyl sulfates; the coconut alkyl glyceryl sulfonates; alkyl ether sulfates wherein the alkyl moiety contains from about 14 to 18 carbon atoms and wherein the average degree of ethoxylation varies between 1 and 6; the sulfated condensation products of tallow alcohol with from about 3 to 10 moles of ethylene oxide; olefin sulfonates containing from about 14 to 16 carbon atoms; alkyl diemthyl amine oxides wherein the alkyl group contains from about 11 to 16 carbon atoms; alkyldimethyl-ammonio-propane-sulfonates and alkyl-dimethyl-ammonio-hydroxy-propane-sulfonates wherein the alkyl group in both types contains from about 14 to 18 carbon atoms; soaps, as hereinabove defined; the condensation product of tallow fatty alcohol with about 11 moles of ethylene oxide; and the condensation product of a $C_{13}$ (avg.) secondary alcohol with 9 moles of ethylene oxide.

Specific preferred detergents for use herein include: sodium linear $C_{10} - C_{18}$ alkyl benzene sulfonate; triethanolamine $C_{10} - C_{18}$ alkyl benzene sulfonate; sodium tallow alkyl sulfate; sodium coconut alkyl glyceryl ether sulfonate; the sodium salt of a sulfated condensation product of a tallow alcohol with from about 3 to about 10 moles of ethylene oxide; the condensation product of a coconut fatty alcohol with about 6 moles of ethylene oxide; the condensation product of tallow fatty alcohol with about 11 moles of ethylene oxide; 3-(N,N-dimethyl-N-coconutalkylammonio)-2-hydroxypropane-1-sulfonate; 3-(N,N-dimethyl-N-coconutalkylammonio-propane-1-sulfonate; 6-(N-dodecylbenzyl-N,N-dimethylammonio)hexanoate; dodecyl dimethyl amine oxide; coconut alkyl dimethyl amine oxide; and the water-soluble sodium and potassium salts of higher fatty acids containing 8 to 24 carbon atoms.

It is to be recognized that any of the foregoing detergents can be used separately herein or as mixtures.

Examples of preferred detergent mixtures herein are as follows.

An especially preferred alkyl ether sulfate detergent component of the instant compositions is a mixture of alkyl ether sulfates, said mixture having an average (arithmetic mean) carbon chain length within the range of from about 12 to 16 carbon atoms, preferably from about 14 to 15 carbon atoms, nd an average (arithmetic mean) degree of ethoxylation of from about 1 to 4 moles of ethylene oxide, preferably from about 2 to 3 moles of ethylene oxide; see copending application of Jacobsen and Krummel, Ser. No. 306,330, filed Nov. 13, 1972, incorporated herein by reference.

Specifically, such preferred mixtures comprise from about 0.05% to 5% by weight of mixture of $C_{12-13}$ compounds, from about 55% to 70% by weight of mixture of $C_{14-15}$ compounds, from about 25% to 40% by weight of mixture of $C_{16-17}$ compounds and from about 0.1% to 5% by weight of mixture of $C_{18-19}$ compounds. Further, such preferred alkyl ether sulfate mixtures comprise from about 15% to 25% by weight of mixture of compounds having a degree of ethoxylation of 0, from about 50% to 65% by weight of mixture of compounds having a degree of ethoxylation from 1 to 4, from about 12% to 22% by weight of mixture of compounds having a degree of ethoxylation from 5 to 8 and from about 0.5% to 10% by weight of mixture of compounds having a degree of ethoxylation greater than 8.

Examples of alkyl ether sulfate mixtures falling within the above-specified ranges are set forth in Table I.

TABLE I

| MIXTURE CHARACTERISTIC | ALKYL | ETHER | SULFATE | MIXTURE |
|---|---|---|---|---|
| Average carbon chain | I | II | III | IV |
| length (No. C Atoms) | 14.86 | 14.68 | 14.86 | 14.88 |
| 12–13 carbon atoms (wt.%) | 4% | 1% | 1% | 3% |
| 14–15 carbon atoms (wt.%) | 55% | 65% | 65% | 57% |
| 16–17 carbon atoms (wt.%) | 36% | 33% | 33% | 38% |
| 18–19 carbon atoms (wt.%) | 5% | 1% | 1% | 2% |
| Average degree of ethoxy- | | | | |
| lation (No. Moles EO) | 1.98 | 2.25 | 2.25 | 3.0 |
| 0 moles ethylene oxide (wt.%) | 15% | 21% | 22.9% | 18% |
| 1–4 moles ethylene oxide (wt.%) | 63% | 59% | 65% | 55% |
| 5–8 moles ethylene oxide (wt.%) | 21% | 17% | 12% 22% | |
| 9+ moles ethylene oxide (wt.%) | 1% | 3% | 0.1% | 5% |
| Salt | K | Na | Na | Na |

The alkali metal silicate solids are used in an amount from about 0.5% to about 3%, preferably from about 0.9% to about 2%. Suitable silicate solids have a molar ratio of $SiO_2$/Alkali metal$_2$O in the range from about 0.5 to about 4.0, preferably from about 2.0 to about 3.4. The alkali metal silicates suitable herein are commercial preparations of the combination of silicone dioxide and alkali metal oxide, fused together in varying proportions according to, for exxample, the following reaction:

$$\underset{\text{(sand)}}{SiO_2} + Na_2CO_3 \xrightarrow{2600^\circ F} \underset{\text{sodium silicate}}{mSiO_2 \cdot Na_2O} + CO_2$$

The value of *m*, frequently termed as the ratio -r- usually ranges from about 0.5 to about 4. Crystalline silicate solids normally possess a high alkalinity content; in addition hydration water is frequently present as, for example, in metasilicates which can exist having 5, 6 or 9 molecules of water. The alkalinity is provided through the monovalent alkali metal ions such as, for example, sodium, potassium, lithium and mixtures thereof. The sodium and potassium silicate solids are generally used. Highly preferred for the compositions herein are the commercially widespread available sodium silicate solids.

The alkali metal silicate solids are preferably incorporated into the instant detergent compositions during the crutching operation together with the other major constituents, particularly the surface-active agent and the water-insoluble aluminosilicate ion exchange material. The required amount of silicate solids can also be incorporated into the detergent composition in the form of colloidal silicates called water glass which are frequently sold as a 20–50% aqueous solution.

Silicate solids, particularly sodium silicate solids, are frequently added to heavy-duty granular detergent compositions as corrosion inhibitors to provide protection to the metal parts of the washing machines in which the alkali washing liquor is utilized. In addition, sodium silicates provide a certain degree of crispness and pourability to detergent granules which is very desirable to avoid lumping and caking, particularly during prolonged storage. It is known, however, that silicate solids cannot easily be incorporated into detergent compositions comprising major amounts of water-insoluble aluminosilicate ion exchange materials as they are capable of enhancing the facilitating the deposition of these water-insoluble particles on the textiles being laundered as well as on the machine. In addition, the concurrent use of alkali metal silicate solids and water-insoluble aluminosilicates apparently adversely affects the capacity and rate of hardness depletion of the ion exchange material in laundry liquor. It is believed that this can be due to a physical blocking of the ion exchange sites on the synthetic zeolites herein. Unexpectedly, a minor effective amount of alkali metal silicate solids has been found to be compatible with a major amount of synthetic aluminosilicate materials in the presence of organic synthetic detergents, thereby providing effective corrosion inhibition and crispness benefits without concurrently enchancing the deposition of the synthetic aluminosilicate particles on the textiles and on the walls of the washing machine.

AUXILIARY BUILDERS

As noted hereinabove, the detergent compositions of the present invention can contain, in addition to the aluminosilicate ion exchange builders, auxiliary, water-soluble builders such as those taught for use in detergent compositions. Such auxiliary builders can be employed to aid in the sequestration of hardness ions and are particularly useful in combination with the aluminosilicate ion exchange builders in situations where magnesium ions contribute significantly to water hardness. Such auxiliary builders can be employed in concentrations of from about 5% to about 50% by weight, preferably from about 10% to about 35% by weight, of the detergent compositions herein to provide their auxiliary builder activity. The auxiliary builders herein include any of the conventional inorganic and organic water-soluble builder salts.

Such auxiliary builders can be, for example, water-soluble salts of phosphates, pyrophosphates, orthophosphates, polyphosphates, phosphonates, carbonates, polyhydroxysulfonates, polyacetates, carboxylates, polycarboxylates, and succinates. Specific examples of inorganic phosphate builders include sodium and potassium tripolyphosphates, pyrophosphates, phosphates, and hexametaphosphates. The polyphosphonates specifically include, for example, the sodium and potassium salts of ethylene diphosphonic acid, and sodium and potassium salts of ethane 1-hydroxy-1, 1-diphosphonic acid and the sodium and potassium salts of ethane-1,1,2-triphosphonic acid. Examples of these and other phosphorus builder compounds are disclosed in U.S. Pat. Nos. 3,159,581, 3,213,030, 3,422,021, 3,422,137, 3,400,176 and 3,400,148, incorporated herein by reference.

Non-phosphorus containing sequestrants can also be selected for use herein as auxiliary builders.

Specific examples of non-phosphorus, inorganic auxiliary detergent builder ingredients include water-soluble inorganic carbonate and bicarbonate salts. The alkali metal, e.g., sodium and potassium, carbonates and bicarbonates are particularly useful herein.

Water-soluble, organic auxiliary builders are also useful herein. For example, the alkali metal, ammonium and substituted ammonium polyacetates, carboxylates, polycarboxylates and polyhydroxysulfonates are useful auxiliary builders in the present compositions. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorus auxiliary builder materials herein include sodium carbonate, sodium bicarbonate, sodium citrate, sodium oxydisuccinate, sodium mellitate, sodium nitrilotriacetate, and sodium ethylenediaminetetraacetate, and mixtures thereof.

Other highly preferred auxiliary builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, methylenemalonic acid, 1,1,2,2-ethane tetracarboxylic acid, dihydroxy tartaric acid and keto-malonic acid.

Additional, preferred auxiliary builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate and phloroglucinol trisulfonate.

Specific examples of highly preferred phosphorus containing auxiliary builder salts for use herein include alkali pyrophosphates whereby the weight ratio of ion exchange material to pyrophosphate is within the range from about 1:2 to about 2:1. Additional preferred auxiliary co-builders such as the alkali salts of sodium tripolyphosphates and nitrilotriacetic acid provide equally superior performance for a weight ratio of ion exchange material to auxiliary builder salt in the range from about 1:1 to about 1:3. The ion exchange aluminosilicates in combination with citrate auxiliary builder salts will provide superior free metal ion depletion in washing liquor when the zeolites used have a molar ratio of $AlO_2$:$SiO_2$ of 1:1. It is understood that in the above preferred ranges of auxiliary builder to aluminosilicate the builder component can be represented by mixtures of said builders.

The detergent compositions herein containing the aluminosilicate ion exchange builder and the auxiliary, water-soluble builder are useful by virtue of the fact that the aluminosilicate preferentially adsorbs calcium ion in the presence of the auxiliary builder material. Accordingly, the calcium hardness ions are primarily removed from solution by the aluminosilicate while the auxiliary builder remains free to sequester other polyvalent hardness ions, such as magnesium and iron ions.

The detergent compositions herein can contain all manner of additional materials commonly found in laundering and cleaning compositions. For example, such compositions can contain thickeners and soil suspending agents such as carboxymethylcellulose and the like. Enzymes, especially the proteolytic and lipolytic enzymes commonly used in laundry detergent compositions, can also be present herein. Various perfumes, optical bleaches, fillers, anti-caking agents, fabric softeners and the like can be present in the compositions to provide the usual benefits occasioned by the use of such materials in detergent compositions. It is to be recognized that all such adjuvant materials are useful herein inasmuch as they are compatible and stable in the presence of the aluminosilicate ion exchange builders.

The granular detergent compositions herein can also advantageously contain a peroxy bleaching component in an amount from about 3% to about 40% by weight, preferably from about 8% to about 33% by weight. Examples of suitable peroxy bleach components for use herein include perborates, persulfates, persilicates, perphosphates, percarbonates and more in general all inorganic and organic peroxy bleaching agents which are known to be adapted for use in the subject compositions.

The detergent compositions of this invention can be prepared by any of the several well known procedures for preparing commercial detergent compositions. For example, the compositions can be prepared by simply admixing the aluminosilicate ion exchange material with the water-soluble organic detergent compound. The adjuvant builder material and optional ingredients can be simply admixed therewith, as desired. Alternatively, an aqueous slurry of the aluminosilicate ion exchange builder containing the dissolved, water-soluble organic detergent compound and the optional and auxiliary materials can be spray-dried in a tower to provide a granular composition. The granules of such spray-dried detergent compositions contain the aluminosilicate ion exchange buider, the organic detergent compound and the optional and auxiliary materials.

The detergent compositions herein are employed in aqueous liquors to cleanse surfaces, especially fabric surfaces, using any of the standard laundering and cleansing techniques. For example, the compositions herein are particularly suited for use in standard automatic washing machines at concentrations of from about 0.01% to about 0.50% by weight. Optimal results are obtained when the compositions herein are employed in an aqueous laundry bath at a level of at least about 0.10% by weight. As in the case of most commercial laundry detergent compositions, the dry compositions herein are usually added to a conventional aqueous laundry solution at a rate of about 1.0 cup/17 gallons of wash water.

The detergent compositions containing such materials have a pH in the range of from about 8.0 to about 11, preferably about 9.5 to about 10.2. As in the case of other standard detergent compositions, the compositions herein function optimally within the basic pH range to remove soils e.g. triglyceride soils and stains. While the aluminosilicates herein inherently provide a basic solution, the detergent compositions comprising the aluminosilicate and the organic detergent compound can additionally contain from about 5% to about 25% by weight of a pH adjusting agent. Such compositions can, of course, contain the auxiliary builder materials and optional ingredients as hereinbefore described. The pH adjusting agent used in such compositions are selected such that the pH of a 0.05% by weight aqueous mixture of said composition is in the range of from about 9.5 to about 10.2.

The optional pH adjusting agents useful herein include any of the water-soluble, basic materials commonly employed in detergent compositions. Typical examples of such water-soluble materials include the sodium phosphates; sodium hydroxide; potassium hydroxide; triethanolamine; diethanolamine; ammonium hydroxide and the like. Preferred pH adjusting agents herein include sodium hydroxide and triethanolamine.

The following examples demonstrate the advantages derivable from the compositions of this invention and also facilitate its understanding. They are in no way meant to limit the scope of the claims, however.

Granular detergent compositions having the following formulae are prepared by spray drying.

| INGREDIENT | COMPOSITION IN % BY WEIGHT | | | |
|---|---|---|---|---|
| | EXAMPLE I | EXAMPLE II | A | B |
| Sodium salt of ethoxylated fatty alcohol sulfate having an average of about 2.25 moles of ethylene oxide per mole of fatty alcohol[1] | 14.1 | 14.1 | 14.1 | 14.1 |
| Sodium tallow alkyl sulfate | 2.4 | 2.4 | 2.4 | 2.4 |
| Sodium silicate solids ratio: $SiO_2/Na_2O = 2.0$ | — | 2.0 | 6.0 | — |
| Sodium silicate solids ratio: $SiO_2/Na_2O = 3.2$ | 1.0 | — | — | 6.0 |
| Sodium tripolyphosphate | 24.0 | 24.0 | 24.0 | 24.0 |
| $Na_{12}(AlO_2.SiO_2)_{12}.27H_2O$[2] | 18.0 | 18.0 | 18.0 | 18.0 |
| Moisture | 10.0 | 10.1 | 9.9 | 10.2 |
| Sodium sulfate | 25.0 | 25.0 | 20.0 | 20.0 |
| Minor ingredients including sodium toluene sulfonate, trisodium sulfosuccinate, dyes, brighteners, perfumes | Balance to 100 | | | |

[1]Fatty alcohol composition: 66% $C_{14}$; 33% $C_{16}$; 1% $C_{18}$.
[2]Prepared as described herein; average particle size diameter 2 microns.

Laundry solutions containing the above detergent compositions are used to determine the deposition of the laundry medium insoluble particles according to the procedure set forth hereinafter.

720 ml. of an aqueous laundering liquor are prepared having the following characteristics:

| | | |
|---|---|---|
| water hardness | : | 9 U.S. grains/gallon |
| product concentration | : | 0.8 gram |
| dissolution/dispersion | : | by agitating 3 minutes |
| solution temperatute | : | 100° F |

The detergent liquor so prepared is then vacuum filtered over a folded piece (2-½× 5 inches) of black double-knit cotton.

The deposition is graded by reference to a photographic 1–10 standard series wherein 10 represents no deposition, and 1 represents a completely white cloth. On such a scale a detergent composition having a 5 grade represents a minimum consumer acceptable performance. The deposition results are as follows:

| COMPOSITION | DEPOSITION GRADE |
|---|---|
| EXAMPLE I | 9.0 |
| EXAMPLE II | 9.5 |
| A | 2.0 |
| B | 1.0 |

The above results show the markedly improved antideposition properties of the compositions of this invention (EXAMPLES I, II) versus what is obtained from similar compositions containing a surface-active agent, a water-insoluble aluminosilicate and a (low) customary amount of silicate solids (COMPOSITIONS A, B). It is reminded that the total elimination of silicate solids would call for the addition of a corrosion inhibition agent, and possibly a crispness agent thereby rendering the detergent composition commercially less attractive due to the increased cost for the more expensive corrosion inhibitors and crispness agents.

Compositions capable of providing substantially similar performance are secured when, in the above-described EXAMPLES I and II compositions, the sodium tallow alkyl sulfate is replaced with an equivalent amount of potassium, lithium, ammonium, mono-, di-, triethanolamine-tallow alkyl sulfate, potassium coconut alkyl surface, or mixtures thereof.

Compositions exhibiting substantially similar performance, physical characteristics, and processability are secured when, in the above-described EXAMPLES I and II compositions, the sodium salt of ethoxylated fatty alcohol sulfate having an average of about 2.25 moles of ethylene oxide per mole of fatty alcohol is replaced by an equivalent amount of sodium linear $C_{10}$–$C_{18}$ alkyl benzene sulfonate; sodium tallow alkyl sulfate; sodium coconut alkyl glyceryl ether sulfonate; the condensation product of a coconut fatty alcohol with about 6 moles of ethylene oxide; the condensation product of tallow fatty alcohol with about 11 moles of ethylene oxide; 3-(N,N-dimethyl-N-coconutalkylammonio)-2-hydroxypropane-1-sulfonate; 3-(N,N-dimethyl-N-coconutallkylammonio)-propane-1-sulfonate; 6-(N-dodecylbenzyl-N,N-dimethyl-ammonio)hexanoate; dodecyl dimethyl amine oxide; coconut alkyl dimethyl amine oxide; and the water-soluble sodium and potassium salts of higher fatty acids containing 8 to 24 carbon atoms, and mixtures thereof.

Substantially similar results are also secured when the synthetic water-insoluble $Na_{12}(AlO_2.SiO_2)_{12}.27 H_2O$ is replaced with an equivalent amount of $Na_{12}.(AlO_2.SiO_2)_{12}.20 H_2O$; $Na_{12}(AlO_2.SiO_2)_{12}.30 H_2O$; $Na_{86}[(AlO_2)_{86}(Sio_2)_{106}].264 H_2O$; and $Na_6[(AlO_2)_6(SiO_2)_{10}].15 H_2O$, respectively.

Superior performance can be obtained when the sodium tripolyphosphate auxiliary builder is substituted by a buider material selected from the group consisting of water-soluble pyrophosphates, carbonates, bicarbonates, silicates, polyacetates, carboxylates, polycarboxylates and mixtures thereof. Substantially similar results are especially secured in replacing sodium tripolyphosphate in Example I with an auxiliary builder selected from the group consisting of sodium pyrophosphate, sodium nitrilotriacetate and sodium citrate; whereby the weight ratio of aluminosilicate ion exchange material to sodium pyrophosphate is in the range from 1:2 to 2:1 and to sodium nitrilotriacetate is in the range from 1:1 to 1:3.

Granular detergent compositions are prepared by spray-drying having the following formulae:

| INGREDIENT | COMPOSITION IN % BY WEIGHT D | EXAMPLE III | EXAMPLE IV | E | F |
|---|---|---|---|---|---|
| Sodium linear dodecylbenzene sulfonate | 10.5 | 10.5 | 10.5 | 10.5 | 10.5 |
| Sodium tallow alkyl sulfate | 1.5 | 1.5 | 1.5 | 1.5 | 1.5 |
| Ethoxylated fatty alcohol having an average of about 3 moles of ethylene oxide per mole of fatty alcohol[1] | 6.0 | 6.0 | 6.0 | 6.0 | 6.0 |
| Sodium silicate solids Ratio: $SiO_2/Na_2O = 2.0$ | — | 2.0 | — | 10.0 | — |
| Sodium silicate solids Ratio: $SiO_2/Na_2O = 3.2$ | — | — | 3.0 | — | 6.0 |
| Moisture | 4.70 | 5.85 | 5.06 | 5.40 | 4.95 |
| Sodium tripolyphosphate | 24.0 | 24.0 | 24.0 | 24.0 | 24.0 |
| $Na_{12}(AlO_2.SiO_2)_{12}.27H_2O$[2] | 18.0 | 18.0 | 18.0 | 18.0 | 18.0 |
| Sodium sulfate and minor ingredients | | | Balance to 100 | | |

[1]Fatty alcohol composition: 39% $C_{14}$; 38% $C_{16}$; 23% $C_{18}$
[2]Prepared as described herein; average particle size diameter 1.5 microns The above compositions are used to determine the deposition grade according to the method described for EXAMPLES I and II hereinbefore.

The deposition results are as follows:

| COMPOSITION | DEPOSITION GRADE |
|---|---|
| D | 8.0 |

-continued

| COMPOSITION | DEPOSITION GRADE |
|---|---|
| EXAMPLE III | 9.0 |
| EXAMPLE IV | 7.0 |
| E | 1.0 |
| F | 2.0 |

The above results again confirm the improved textile appearance benefits derivable from the compositions of this invention versus what is obtained from granular detergent compositions containing water-insoluble aluminosilicate ion exchange materials in combination with a conventional (6%–20%) level of sodium silicate solids.

Substantially similar results are also obtained when the aluminosilicate of EXAMPLES III and IV is replaced with an aluminosilicate ion exchange material having an average particle size diameter of 0.2; 0.4; 0.6; 0.8; 1.2; 1.75; 2.20; 2.60; 3.40; 4.0; 5.30; 6.20; 7.50; 8.70 and 9.80 microns, respectively.

What is claimed is:

1. A spray-dried granular detergent composition capable of rapidly reducing the free polyvalent metal ion content of an aqueous solution, comprising:

a. from about 5% to about 92% by weight of a water-insoluble aluminosilicate ion exchange material of the formula $$Na_z[(AlO_2)_z.(SiO_2)_y]x\ H_2O$$

wherein $z$ and $y$ are integers of at least 6; the molar ratio of $z$ to $y$ is in the range from 1.0 to about 0.5, and $x$ is an integer from about 15 to about 264; said aluminosilicate ion exchange material having a particle size diameter from about 0.1 micron to about 100 microns; a calcium ion exchange capacity of at least about 200 mg. eq. $CaCO_3$/g.; and a calcium ion exchange rate expressed as $CaCO_3$ of at least about 2 grains/gallon/minute/gram;

b. from about 5% to about 92% by weight of a water-soluble organic surface-active agent selected from the group consisting of anionic, nonionic, ampholytic and zwitterionic surface-active agents and mixtures thereof; and c. from about 0.5% to 3% by weight of an alkali metal silicate solid having a molar ratio of $SiO_2$ to alkali metal oxide in the range from about 0.5 to about 4.0.

2. A composition in accordance with claim 1 wherein said aluminosilicate ion exchange material has a particle size diameter of from about 0.2 micron to about 10 microns.

3. A composition in accordance with claim 2 wherein said silicate solids are present in an amount from 0.9% to about 2% by weight.

4. A composition in accordance with claim 3 wherein said aluminosilicate ion exchange material has a molar ratio of *z* to *y* in the range from 1.0 to about 0.8.

5. A composition in accordance with claim 4 which, in addition, contains from about 5% to about 50% by weight of an auxiliary detergent builder salt.

6. A composition in accordance with claim 5 wherein said auxiliary detergent builder salt is selected from the group consisting of sodium pyrophosphate, sodium tripolyphosphate, sodium carbonate, sodium bicarbonate, sodium citrate, sodium oxydisuccinate, sodium mellitate, sodium nitrilotriacetate, sodium ethylenediaminetetraacetate, sodium polymaleate, sodium polyitaconate, sodium polymesaconate, sodium polyfumarate, sodium polyaconitate, sodium polycitraconate, sodium polymethylenemalonate, sodium carboxymethyloxymalonate, sodium carboxymethyloxysuccinate, sodium cic-cyclohexanehexacarboxylate, sodium cis-cyclopentanetetracarboxylate, and sodium phloroglucinoltrisulfonate.

7. A composition in accordance with claim 6 wherein said surface-active agent is a water-soluble salt of an organic sulfuric reaction product having in its molecular structure an alkyl group containing from about 8 to about 22 carbon atoms and a sulfonic acid or sulfuric acid ester group.

8. A composition in accordance with claim 6 wherein said surface-active component is a water-soluble soap.

9. A composition in accordance with claim 6 wherein said silicate solids have a molar ratio of $SiO_2$ to alkali metal oxide in the range from about 2.0 to about 3.4 and wherein said alkali metal oxide is selected from sodium oxide, potassium oxide and mixtures thereof.

10. A composition in accordance with claim 9 wherein the water-soluble organic detergent compound is a mixture of alkyl ether sulfate compounds, comprising: from about 0.05% to 5% by weight of mixture of $C_{12-13}$ compounds, from about 55% to 70% by weight of mixture of $C_{14-15}$ compounds, from about 25% to 40% by weight of mixture of $C_{16-17}$ compounds, from about 0.1% to 5% by weight of mixture of $C_{18-19}$ compounds, from about 15% to 25% by weight of mixture of compounds having a degree of ethoxylation of 0, from about 50% to 65% by weight of mixture of compounds having a degree of ethoxylation from 1 to 4, from about 12% to 22% by weight of mixture of compounds having a degree of ethoxylation from 5 to 8 and from about 0.5% to 10% by weight of mixture of compounds having a degree of ethoxylation greater than 8.

11. A detergent composition capable of rapidly reducing the free polyvalent metal ion content of an aqueous solution, comprising:

a. from about 10% to about 50% by weight of a water-insoluble inorganic aluminosilicate ion exchange material of the formula $$Na_{12}[(AlO_2)_{12}.(SiO_2)_{12}].x\ H_2O$$

wherein x is an integer of from about 20 to about 30, and characterized by a particle diameter of from about 0.1 micron to about 10 microns, a calcium ion exchange capacity of at least about 200 mg eq.$CaCO_3$/g., and a calcium ion exchange rate, expressed as $CaCO_3$, of at least about 2 grains/gallon/gram; and b. from about 7% to about 50% by weight of a water-soluble organic surface-active agent selected from the group consisting of anionic, nonionic, ampholytic, and zwitterionic detergents, and mixtures thereof;

c. from about 0.9% to about 2% by weight of an alkali metal silicate solid having a molar ration of $SiO_2$ to alkali metal oxide in the range from about 2.0 to about 3.4 and wherein the alkali metal oxide is selected from sodium oxide, potassium oxide and mixtures thereof; and d. from about 10% to about 35% by weight of an auxiliary detergent builder salt.

12. A composition in accordance with claim 11 wherein said aluminosilicate ion exchange material is $$Na_{12}(AlO_2.SiO_2)_{12}.27\ H_2O.$$

13. A composition in accordance with claim 11 wherein said surface-active agent is a water-soluble salt of an organic sulfuric reaction product having in its molecular structure an alkyl group containing from about 8 to about 22 carbon atoms and a sulfonic acid or sulfuric acid ester group.

14. A composition in accordance with claim 11 wherein said surface-active agent is a water-soluble soap.

15. A composition in accordance with claim 11 wherein said auxiliary builder is selected from the group consisting of sodium pyrophosphate, sodium tripolyphosphate, sodium carbonate, sodium bicarbonate, sodium citrate, sodium oxydisuccinate, sodium mellitate, sodium nitrilotriacetate, sodium ethylenediaminetetraacetate, sodium polymaleate, sodium polyitaconate, sodium polymesaconate, sodium polyfumarate, sodium polyaconitate, sodium polycitraconate, sodium polymethylenemalonate, sodium carboxymethyloxymalonate, sodium carboxymethyloxysuccinate, sodium cis-cyclohexanehexacarboxylate, sodium cis-cyclopentanetetracarboxylate and sodium phloroglucinoltrisulfonate.

16. A composition in accordance with claim 15 wherein the water-soluble organic surface-active component is selected from the group consisting of sodium linear $C_{10}$–$C_{18}$ alkyl benzene sulfonate; triethanolamine $C_{10}$–$C_{18}$ alkyl benzene sulfonate; sodium tallow alkyl sulfate; sodium coconut alkyl glyceryl ether sulfonate; the sodium salt of a sulfated condensation product of a tallow alcohol with from about 3 to about 10 moles of ethylene oxide; the condensation product of a coconut fatty alcohol with about 6 moles of ethylene oxide; the condensation product of tallow fatty alcohol with about 11 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio hexanoate, dodecyl dimethyl amine oxide; coconut alkyl dimethyl amine oxide; the water-soluble sodium and potassium salts of higher fatty acids containing 8 to 24 carbon atoms and mixtures thereof.

17. A composition in accordance with claim 16 wherein said auxiliary builder is selected from the group consisting of sodium pyrophosphate, sodium tripolyphosphate, sodium nitrilotriacetate and sodium citrate.

18. A composition in accordance with claim 17 wherein the weight ratio of said aluminosilicate ion exchange material to said pyrophosphate is in the range from about 1:2 to about 2:1.

19. A composition in accordance with claim 17 wherein the weight ratio of said aluminosilicate ion exchange material to said auxiliary builder selected from the group consisting of sodium tripolyphosphate and sodium nitrilotriacetate is in the range from about 1:1 to about 1:3.

* * * * *